US005822834A

United States Patent [19]

Jourde et al.

[11] Patent Number: 5,822,834

[45] Date of Patent: Oct. 20, 1998

[54] NEEDLING MACHINE WITH SLIDING ROD

[75] Inventors: Bernard Jourde, Elbeuf; Francois Louis, La Saussaye; Robert Jean, Amfreville la Campagne, all of France

[73] Assignee: Asselin, Elbeuf, France

[21] Appl. No.: 849,478

[22] PCT Filed: Dec. 7, 1995

[86] PCT No.: PCT/FR95/01618

§ 371 Date: Jul. 16, 1997

§ 102(e) Date: Jul. 16, 1997

[87] PCT Pub. No.: WO96/17987

PCT Pub. Date: Jun. 13, 1996

[30] Foreign Application Priority Data

Dec. 8, 1994 [FR] France ..... 94 14760

[51] Int. Cl.[6] ..... D04H 18/00

[52] U.S. Cl. ..... 28/113; 28/107

[58] Field of Search ..... 28/107, 108, 109, 28/110, 111, 112, 113, 114, 115; 112/80.4, 80.45

[56] References Cited

U.S. PATENT DOCUMENTS 3,798,747 3/1974 Brochetti .
3,889,326 6/1975 Tyas .
4,891,870 1/1990 Müller ..... 28/107
4,977,653 12/1990 Pum ..... 28/107

FOREIGN PATENT DOCUMENTS 2224579 10/1974 France .
1343763 1/1974 United Kingdom .

*Primary Examiner*—Peter Nerbun
*Assistant Examiner*—Larry D. Worrell, Jr.
*Attorney, Agent, or Firm*—Greer, Burns & Crain, Ltd.

[57] ABSTRACT

A needle loom including a support and a stripper defining a path for a fiber lap. A needle board supported by sliding shanks moves back and forth between a maximum penetration position and a retracted position, by means of a connecting rod/crank assembly including a connecting rod hingedly connected to the sliding shank. A slide bearing remote from the needle board has a greater diameter than the other slide bearing, and engages a tubular portion of the shank. The hinge connection between the connecting rod and the sliding stank is located within the axial section covered by the slide bearing and the interval therebetween. For this purpose, the hinge is arranged in the tubular portion. Bearing wear, extraneous stress and vibration may thus be reduced.

14 Claims, 1 Drawing Sheet

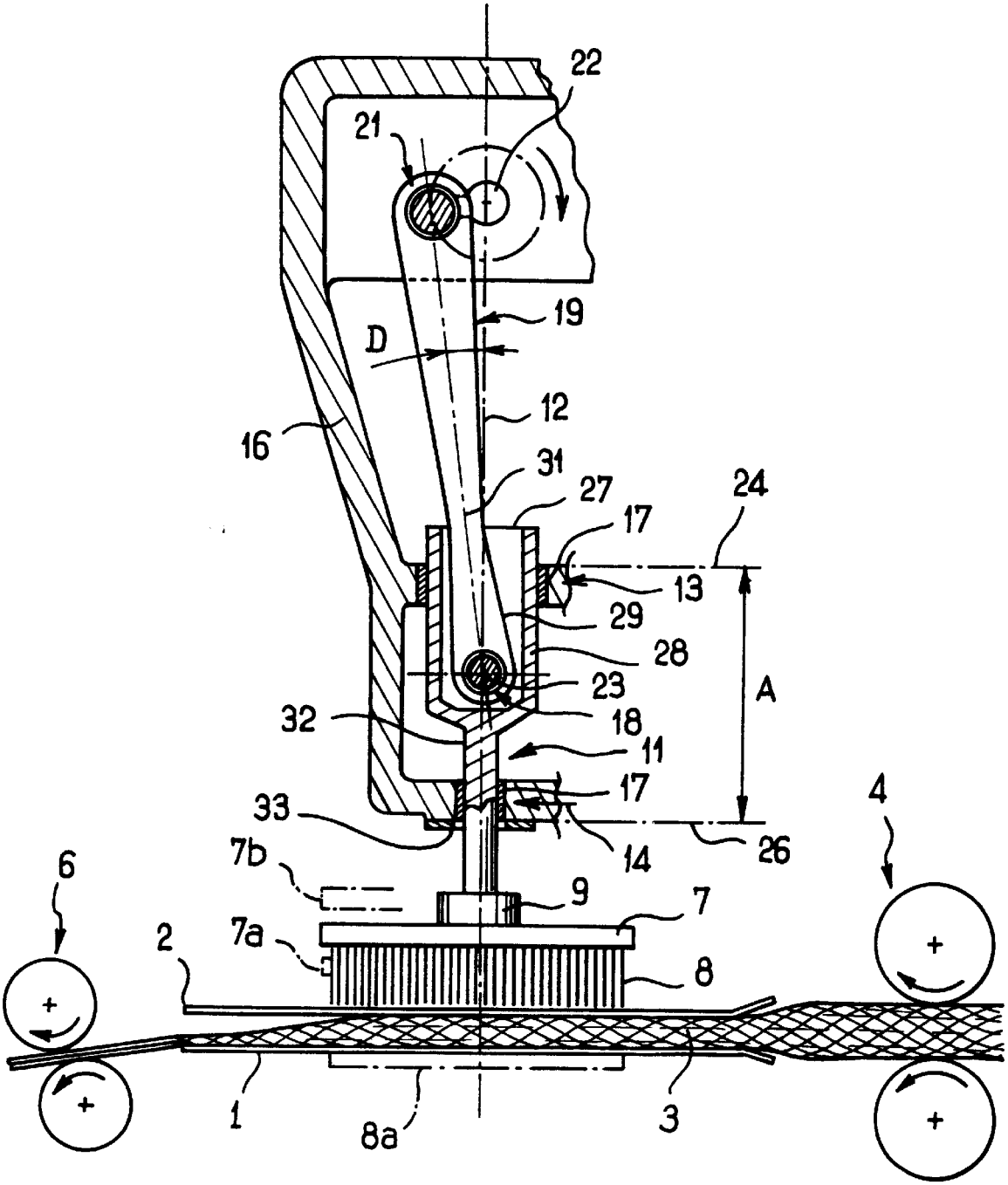
22
21
19
D
12
16
31
27
24
17
13
29
28
23
A
32
18
11
17
33
14
26
4
6
7b
9
7
2
7a
8
1
8a
3

NEEDLING MACHINE WITH SLIDING ROD

BACKGROUND OF THE INVENTION

The present invention relates to a needling machine used for the mechanical consolidation of a sheet—or fleece—of fibres coming, for example, from a spreading and fleecing machine (so-called "cross-lapper").

Known needling machines comprise a support called a board on which needles are fixed. By means of crank and connecting rod devices, the board is reciprocated in order that these needles traverse the sheet of fibres at a production rate which can be of the order of 1000 to 2000 strikes per minute.

The alternating—i.e. reciprocating—motion of the needle board is obtained by means of a crank and connecting rod device.

Complementary devices also make it possible to regulate the flow of fibres entering and leaving the machine, with or without stretch, and at speeds chosen according to the strike rate expressed as a number of strikes per minute, which is equivalent to the number of alternating movements of the needles per minute.

The major disadvantage of these needling machines is in their speed limitation, which is incompatible with increasing production rates. In fact, the market requires increasingly fast machines.

Conventionally, the connecting rod of each crank and connecting rod device extends between an eccentric, connected to a motor, and an articulation at the end of a sliding rod to which is fixed a needle board support. In order that it may slide, the sliding rod passes through two slide bearings located at a certain distance from one another.

This arrangement has many disadvantages. When the board is at the end of its travel at which the needles are withdrawn from the product, the articulation of the rod is distant from the bearings and consequently the connecting rod applies forces to the sliding rod under poor guidance conditions, creating large flexion moments in the sliding rod and high stresses in the bearings. In order to lighten the system and reduce its overall height, there is a temptation to reduce the length of the connecting rod. But this increases the angular stroke of the connecting rod about the articulation with the sliding rod and therefore increases the value of the undesirable transverse force component which is transmitted to the rod's slide bearings. It is the bearing closest to the articulation which is particularly dangerously loaded, typically by three to ten times as much as the other one. These bearings are subject to their maximum load, with a jamming tendency which becomes greater as the inclination of the connecting rod becomes greater, when the connecting rod pushes the sliding rod in order to make the needles penetrate into the fibrous products. Instead of shortening the connecting rod, it is possible to consider shortening the sliding rod. But this would result in bringing the two slide bearings towards each other in an exaggerated manner to the point at which the sliding rod would no longer be guided with sufficient accuracy. Thus, up to the present time, bulky assemblies have been tolerated in which the mobile systems are heavy and consequently produce lots of vibration whilst obliging manufacturers to limit the operating speed.

GB-A-1 343 763 indeed proposes an arrangement in which the articulation between connecting rod and sliding rod is placed inside the sliding rod which is made in tubular form. Thus the slide bearing at the crank end can be placed closer to the crank because the articulation can, at least for certain angular positions of the crank, be engaged in the slide bearing. But the bearings then have a very large diameter and in practice it proves that their fluid-tightness is then difficult to achieve. The sliding rod is heavy and the assembly is expensive. U.S. Pat. No. 3,798,717 and FR-A-2 224 579 overcome this difficulty by placing the articulation such that it is always located between the upper and lower slide bearings but the assembly then becomes very complex mechanically and expensive.

The purpose of the present invention is thus to propose a simple needling machine which can function continuously at high speed and with favourable vibratory behaviour.

BRIEF SUMMARY OF THE INVENTION

According to the invention the needling machine for mechanically consolidating a sheet of fibres comprising, means of causing the sheet of fibres to progress, a mobile system comprising a needle board support and at least one rod mounted such that it slides in a transverse direction with respect to the sheet in two axially spaced slide bearings, for each sliding rod, a connecting rod having a first end articulated with a drive crank and a second end connected to the sliding rod by an articulation, in order to transmit a reciprocating motion to the support, is characterized in that the sliding rod comprises a first region, of relatively large outer diameter, sliding through the first of the slide bearings, located at the end nearer the crank and having a corresponding relatively large diameter, the sliding rod having a smaller diameter in a second region sliding in the other bearing, having a corresponding smaller diameter, and located at the end nearer the needle board support.

All of the problems mentioned above are solved due to the adoption of two different diameters for the sliding rod and the slide bearings. The sliding rod and the bearing at the end near the crank have considerable strength in the most loaded zone, in the vicinity of the articulation with the connecting rod. The other bearing, which is less loaded, has a small diameter. Thus the sliding rod is lightened where this is possible and this reduces its inertia. Furthermore, the sliding guidance obtained is more accurate than with two bearings of large diameter because the difference in diameter increases the real distance between the two guidances, with respect to the distance measured along the axis. It is therefore possible to shorten the sliding rod and thus to increase the rigidity of the mechanism with respect to the lateral forces applied in particular by the fibres in motion which tend to drag the needle board. The guidance achieved is furthermore less sensitive to thermal differences because the dimensional variations of the small-diameter bearing are smaller in absolute value. The small-diameter bearing is less expensive and its fluid-tightness, when this is necessary, is easier to achieve.

Preferably, the sliding rod is made such that it is tubular over at least a portion of its length starting from the end nearest the crank. In an even more preferred way, the articulation between the sliding rod and the connecting rod is formed inside the sliding rod. It is then very preferably that, at least during a portion of the travel of the sliding rod, the axis of the said articulation between the connecting rod and the sliding rod is located in the axial extent covered by the two slide bearings and by the distance between them.

It is thus possible to increase the length of the connecting rod and consequently to reduce the angular stroke thereof without modifying the overall dimension measured in the direction of the reciprocatory sliding. Consequently, on the one hand, the parasitic lateral forces resulting from the angular deflection of the connecting rod are reduced and, on the other hand, due to the reduction or elimination of the cantilever action of these forces with respect to the bearings, the flexion moments produced by the parasitic forces are even further reduced.

The wearing of the slide bearings, which constitute one of the conventional weak points of needling machines, is therefore reduced.

Other features and advantages of the invention will emerge from the following description relating to a non-limitative example.

BRIEF DESCRIPTION OF THE DRAWINGS

The accompanying FIGURE is a diagrammatic view in elevation, with a partial cross-section and tear-away, of a needling machine according to the invention.

DETAILED DESCRIPTION OF THE INVENTION

The needling machine shown in the figure comprises a generally horizontal perforated table 1 and a retaining plate 2, also called a "stripper", placed approximately parallel to and at a certain distance above the table 1. The table 1 and the stripper 2 between them define a path in an approximately horizontal plane for a sheet of fibres 3. The stripper 2 comprises perforations aligned with those of the table 1. At the entrance of the path there are placed insertion means 4 represented as a pair of drive rollers between which the sheet 3 passes. At the exit of the path, the sheet 3, consolidated and compacted by needling, is driven by extraction means 6, also represented by two drive rollers between which the sheet passes.

A needle board 7 is positioned facing the side of the stripper 2 which faces away from the path of the sheet 3. The board 7 carries, on the side facing the stripper 2, a large number of needles 8 oriented perpendicularly to the plane of the path of the sheet 3, with their points facing towards the sheet 3. Each needle is positioned opposite a perforation of the stripper 2 and a corresponding perforation of the table 1. The needle board 7 is fixed, on the side opposite to that of the needles 8, to a support 9 which is itself fixed to the end of at least one rod 11 mounted such that it slides in a direction 12 parallel with the needles 8 and perpendicular to the plane of the path of the sheet 3. If several rods 11 are provided, they are for example aligned one behind the other when seen as shown in the single figure. For its sliding guidance, each sliding rod 11 is guided in two coaxial slide bearings 13 and 14 integral with a frame 16 which is shown only partially. The bearings 13 and 14 comprise anti-friction bushes 17 for contact with the sliding rod 11.

The mobile system consisting of the sliding rod or rods 11, the support 9 and the board 7 is driven in service with an alternating forward-and-backward motion in the direction 12 between a position 7*a* in which the needles, whose ends are indicated in this case by 8*a*, traverse the stripper 2, the sheet 3 and the table 1, and a separated position 7*b* in which the needles 8 are totally withdrawn at least from the table 1 and the sheet 3, and possibly from the stripper 2.

In order to impart this forward-and-backward motion to the mobile system, the sliding rod 11 is articulated by an articulation 18 to one end of a connecting rod 19 whose other end is connected by an articulation 21 to a crank 22 driven in rotation by driving means which are not shown. The frame 16 defines a closed casing housing the crank and connecting rod assembly 21, 22 and the bearing 13 which is the closest one to it. The bearing 14 forms the lower limit of the closed casing. A oil-sealing device 32 is fixed to the frame 16 around the sliding rod 11 on the side nearest the support 9 with respect to the bearing 14 in order to prevent the lubricant of the bearings 14, 17, and of the crank and connecting rod assembly, from leaking from the closed casing along the sliding rod 11 towards the needling zone.

The sliding rod 11 comprises, starting from its and 27 facing the connecting rod 19, a first region 28 which is made tubular with the internal space of the tube emerging through the end 27. The first region 28 has a cylindrical outer surface which is engaged in a sliding manner in that one 13 of the bearings 13 and 14 which is closest to the crank 22. The sliding rod 11 furthermore comprises a second region 32 which has a smaller diameter than that of the first region 28. The second region 32 is made solid, that is to say non-tubular in particular, and its cylindrical outer surface slides in the bearing 14 which is closest to the needle board 7 and in the sealing device 32.

The geometric axis 23 of the articulation 18 between the sliding rod 11 and the connecting rod 19, which axis is parallel to the plane of the path of the sheet 3, is located, at least during a portion of the forward and backward travel, in the axial extent A covered by the two bearings 13 and 14 and by the distance between them, in other words between the planes 24 and 26 each of which limits one of the bearings 13 and 14 on the side furthest from the other bearing 14 or 13 respectively.

In the example shown, the axis 23 is always located within the axial extent A.

In order to achieve this condition, the articulation 18 is formed in the internal space 29 of the tubular region 28 and the connecting rod 19 is engaged in the internal space 29 through the open end 27. When it is seen in a direction parallel to its axes of articulation as in the single figure, the connecting rod 19 has a contour having a narrowing 31 substantially in the plane of the end 27 of the sliding rod 11 in order to allow the connecting rod 19 to undergo its angular stroke about the axis 23 of the articulation 18 without the orifice of the end 27 having to be too big.

The connecting rod 19 can be made longer than it conventionally is and the axial extent A can also be particularly long without the overall size of the needling machine being prohibitive since these two dimensions are partially superimposed. Due to the long connecting rod 19, its maximum angular deflection D is particularly low for a predetermined forward and backward travel of the needles 8. This minimizes the parasitic lateral forces on the bearings 13 and 14 as well as certain types of vibration. Due to the axial extent A, the guidance of the sliding rod 11 is of very good quality. As the articulation 18 is no longer in a cantilever position of the sliding rod 11 with respect to the bearings 13 and 14, the operating forces are much less harmful to the bearings 13 and 14. The sliding rod 11 undergoes less flexion. It is furthermore reinforced by its tubular structure. The bearing 13, which is the most loaded one in service, has a considerably increased diameter which renders it particularly resistant to wear.

Due to its numerous advantages, the needling machine according to the invention is capable of functioning continuously at very high rates.

The invention is not of course limited to the example described and shown.

It would be possible to make the sliding rods 11 tubular over their entire length. It would be possible to place the articulation 18 in such a way that it hardly penetrates into the axial extent A when the needles are in the position 8*a* of maximum penetration.

It is not necessary for the connecting rod to have a narrowing, even in the case in which it is articulated inside a tubular region of the sliding rod. To achieve this the articulation 18 can be raised a little or the internal diameter of the end 27 can be increased.

The invention is applicable to all types of needling machine, in particular to needling machines with a perforated table such as described by way of example, but also to needling machines for manufacturing velvet, terry, etcetera.

We claim:

1. A needling machine for mechanically consolidating a sheet of fibers comprising, means for causing the sheet of fibers to progress, a mobile system comprising a needle board support and at least one rod mounted for sliding movement in a transverse direction with respect to the sheet in two axially spaced slide bearings, for each said sliding rod, a connecting rod having a first end articulated with a drive crank and a second end connected to said sliding rod by an articulation, in order to transmit a reciprocating motion to the support, wherein each said sliding rod comprises a first region having a first outer diameter, sliding through a first one of the slide bearings, said first bearing located nearer the crank and having a corresponding first inner diameter, the sliding rod having a second outer diameter in a second region sliding in the other bearing, said other bearing having a corresponding second inner diameter, and located nearer the needle board support, and wherein said second outer diameter is smaller than said first outer diameter, and said second inner diameter is smaller than said first inner diameter.

2. A needling machine according to claim 1, characterized in that the sliding rod is made tubular over at least a portion of its length starting from an end facing the connecting rod.

3. A needling machine according to claim 1, characterized in that the articulation between the sliding rod and the connecting rod is formed inside the sliding rod.

4. A needling machine according to claim 3, characterized in that the articulation has an articulation axis which is, at least over a portion of its reciprocating travel, in the axial extent covered by the two slide bearings and by the distance between them.

5. A needling machine according to claim 3, characterized in that the connecting rod, seen in a direction parallel to an articulation axis, has a narrowing in a region traversing a tubular end of the sliding rod.

6. A needling machine according to claim 1, characterized in that the articulation between the connecting rod and the sliding rod is located between the slide bearings.

7. A needling machine according to claim 1, characterized in that the sliding rod is made tubular in the first region.

8. A needling machine according to claim 1, characterized in that the second region of the sliding rod is made solid.

9. A needling machine according to claim 1, characterized in that the second region of the sliding rod is surrounded by a sealing device.

10. A needling machine according to claim 2, characterized in that the articulation between the sliding rod and the connecting rod is formed inside the sliding rod.

11. A needling machine according to claim 4, characterized in that the connecting rod, seen in a direction parallel to the articulation axis, has a narrowing in a region traversing a tubular end of the sliding rod.

12. A needling machine according to claim 7, characterized in that the second region of the sliding rod is made solid.

13. A needling machine for mechanically consolidating a sheet of fibers comprising, means for causing the sheet of fibers to progress, a mobile system comprising a needle board support and at least one rod mounted for sliding movement in a transverse direction with respect to the sheet in two axially spaced slide bearings, for each said sliding rod, a connecting rod having a first end articulated with a drive crank and a second end connected to said sliding rod by an articulation, in order to transmit a reciprocating motion to the support, each said sliding rod having a tubular region facing said connecting rod and dimensioned so that the articulation between the sliding rod and the connecting rod is formed inside said tubular portion of the sliding rod.

14. A needling machine according to claim 13, wherein each sliding rod comprises a first region having a first outer diameter, sliding through a first one of the slide bearings, said first bearing located nearer the crank and having a corresponding first inner diameter, the sliding rod having a second outer diameter in a second region sliding in the other bearing, said other bearing having a corresponding second inner diameter, and located nearer the needle board support, and wherein said second outer diameter is smaller than said first outer diameter, and said second inner diameter is smaller than said first inner diameter.

* * * * *